United States Patent [19]

Murata

[11] 4,153,829

[45] May 8, 1979

[54] PUSHBUTTON SWITCH ASSEMBLY

[75] Inventor: Taneo Murata, Tokyo, Japan

[73] Assignee: Alps Electric Co., Ltd., Japan

[21] Appl. No.: 768,982

[22] Filed: Feb. 16, 1977

[30] Foreign Application Priority Data

Feb. 20, 1976 [JP] Japan ..... 52-19244

[51] Int. Cl.[2] ..... H01H 3/12

[52] U.S. Cl. ..... 200/340

[58] Field of Search ..... 200/340, 159 R, 5 R, 200/5 A, 159 A, 159 B

[56] References Cited

U.S. PATENT DOCUMENTS

| | | | |
|---|---|---|---|
| 3,674,970 | 7/1972 | Bedocs | 200/340 |
| 3,969,600 | 7/1976 | Sims | 200/340 |
| 3,978,297 | 8/1976 | Lynn | 200/340 |
| 4,029,916 | 6/1977 | Chu | 200/340 |
| 4,056,700 | 11/1977 | Stanner | 200/340 |

*Primary Examiner*—Ro E. Hart

*Attorney, Agent, or Firm*—Guy W. Shoup; Gerard F. Dunne

[57] ABSTRACT

A pushbutton switch is disclosed which comprises a housing and a contact unit contained in the housing. The contact unit includes a fixed contact member, a movable contact member disposed in parallel, spaced relation with the fixed contact member, an insulating member interposed between the fixed and movable contact members and formed with an opening. The movable contact member has a snap-action disc portion preformed so as to bow at its center away from the fixed contact member so that when the disc portion is pushed it is snapped to project through the opening of the insulating member into contact with the fixed contact member. The contact unit also includes a resilient member disposed adjacent the movable contact member and having a projection extending toward the center of the disc portion for pushing the disc portion. A spring member is provided to have a zigzagged portion for pushing the resilient member toward the movable contact member. Also provided is a lever supported for reciprocating movement in the housing to push the zigzagged portion so as to drive the resilient member, thereby accomplishing a contact between the fixed contact member and the movable contact member.

1 Claim, 5 Drawing Figures

PUSHBUTTON SWITCH ASSEMBLY

BACKGROUND OF THE INVENTION

The present invention relates to an improved pushbutton switch for use in a table electronic calculator or a terminal device.

SUMMARY OF THE INVENTION

It is an object of the present invention to provide an improved pushbutton switch having a superior electrical characteristic.

Another object of the present invention is to provide an improved pushbutton switch performing a stabilized switching operation without sliding noises.

Still another object of the present invention is to provide an improved pushbutton switch which is effective to prevent its contacts from chattering.

In accordance with the present invention, there is provided a pushbutton switch comprising a housing and a contact unit contained in the housing. The contact unit includes a fixed contact member, a movable contact member disposed in parallel, spaced relation with the fixed contact member, and an insulating member interposed between the fixed and movable contact members and formed with an opening. The movable contact member has a snap-action disc portion preformed so as to bow at its center away from the fixed contact member so that when the disc portion is pushed it is snapped to project through the opening of the insulating member into contact with the fixed contact member. The contact unit also includes a resilient member disposed adjacent the movable contact member and having a projection extending toward the center of the disc portion for pushing the disc portion. A spring member is provided to have a zigzagged portion for pushing the resilient member toward the movable contact member. Also provided is a lever supported for reciprocating movement in the housing to push the zigzagged portion so as to drive the resilient member, thereby accomplishing a contact between the fixed contact member and the movable contact member.

DESCRIPTION OF THE DRAWINGS

A better understanding of the present invention as well as other objects and further features thereof will become apparent upon consideration of the following detailed disclosure thereof, especially when taken with the accompanying drawings, in which.

DESCRIPTION OF THE PREFERRED EMBODIMENT

Figure 1:
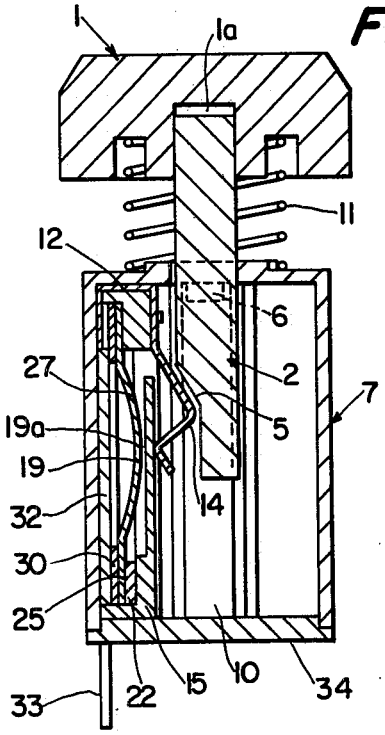
FIG. 1 is a sectional view of the pushbutton switch of the present invention.
Figure 2:
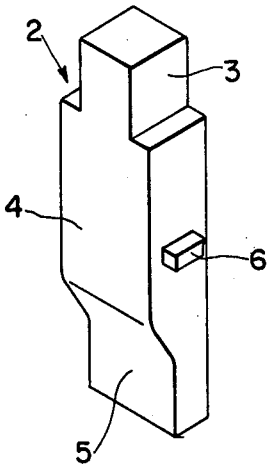
FIG. 2 is a perspective view of the lever.
Figure 3:
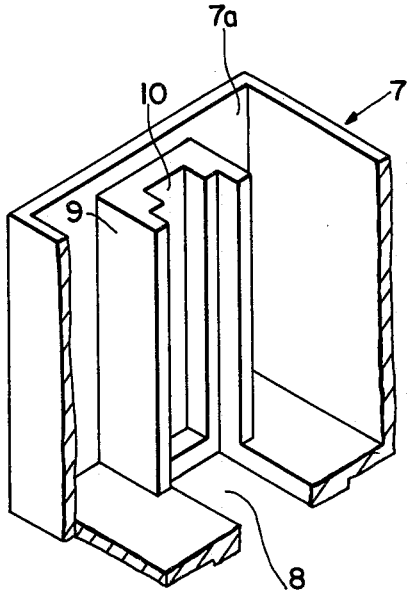
FIG. 3 is a perspective view partly in section showing the interior of the housing.
Figure 5:
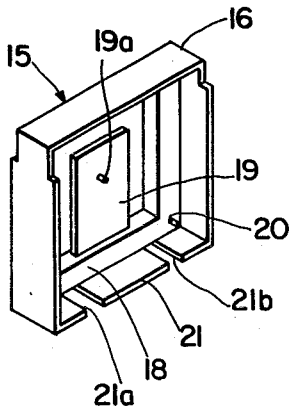
FIG. 5 is a perspective view showing the rear side of the contact casing.

There is shown in FIGS. 1 to 3 a pushbutton switch in accordance with the present invention, which comprises a pushbutton 1 formed of a synthetic resin and formed with a recess 1*a*. Inserted and fixed in the recess 1*a* is a lever 2 formed of a synthetic resin and formed integrally with a head portion 3 fixed in the recess 1*a*, a main portion 4, an inclined portion 5, and projecting portions 6 and 6 extending outwardly from the opposite sides of the main portion 4 as shown in FIG. 2. Indicated by the reference numeral 7 is a housing formed in its upper surface with a hole 8 through which the lever 2 is inserted therein. The housing 7 contains a pair of support members 9 and 9 attached to the opposite side walls of the housing 7, each of which is formed with a stepped guide groove 10 having a narrow portion and a wide portion so that the lever 2 can slide up and down along the guide grooves 10 and 10 with its main portion 4 maintained in sliding contact with the wide portions and its projecting portions 6 and 6 maintained in sliding contact with the narrow portions.

A coil spring 11 is interposed between the pushbutton 1 and the upper surface of the housing 7 for urging the pushbutton 1 upwardly until the projecting portions 6 and 6 of the lever 2 abut on an inner surface of the housing 7.

Figure 4:
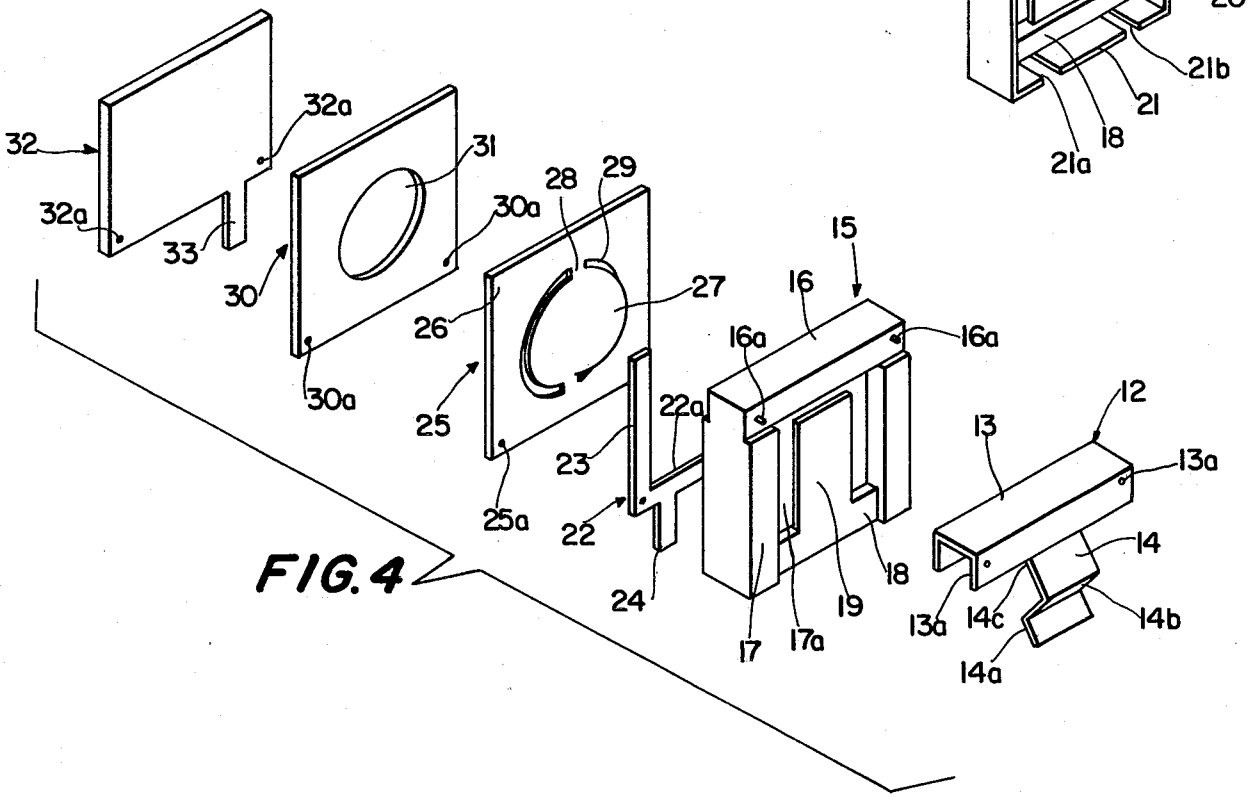
FIG. 4 is an exploded perspective view of the contact unit and the spring member.

The housing 7 also contains a spring member 12 and a contact casing 15 containing therein a contact unit composed of a terminal member 22, a movable contact member 25, an insulating member 30, and a fixed contact member 32 as shown in FIG. 4. The spring member 12 is made of a resilient metal plate and formed integrally with a U-shaped attachment portion 13 fitted onto the head portion 16 of the contact casing 15 and a zigzagged portion 14 having portions 14*a*, 14*b* and 14*c* as illustrated in FIG. 4. The head portion 16 of the contact casing 15 has projections 16*a* and 16*a* at its opposite end portions, which are inserted into the holes 13*a* and 13*a* formed in the head portion 13 of the spring member 12 and then caulked to attach the spring member 12 to the contact casing 15.

Disposed in the opening 17*a* of the front frame 17 of the contact casing 15 is a thin resilient member 19 having its one end coupled to the lower edge 18 of the front frame 17*a* and provided with a projection 19*a* on its rear surface.

The terminal member 22 is formed of a rigid metal plate such as a phosphor-bronze plate and formed integrally with an L-shaped connection portion 23 and an external terminal 24 extending outwardly though a recess 21*a* formed in the lower surface of the contact casing 15. The terminal member 22 is fixed to the movable contact member 25 such as by welding. The movable contact member 25 is formed of a resilient thin metal plate such as a beryllium copper plate to have a square area substantially equal to the cross sectional area of the contact casing 15. The movable contact member 25 is formed integrally with an attachment portion 26 to which the terminal member 22 is fixed, a disc portion 27 preformed so as to slightly bow at its center toward the resilient member 19. Support portions 28, and semi-circular grooves 29 and 29 facilitate the snap-action of the disc portion 27. The insulating member 30 is formed of a synthetic resin to have a square area substantially equal to the square area of the movable contact member 25 for insulating the movable contact member 25 from the fixed contact member 32. The insulating member 30 is formed at its center with an opening 31 having an area sufficient to receive the snapped disc plate 27 of the movable contact plate 25. The rectangular-shaped fixed contact member 32 is formed of a gold-plated phosphor-bronze plate and is provided with an external terminal 33 extending outwardly through a recess 21*b*formed in the lower surface of the contact casing 15.

The reference numeral 34 indicates a rectangular-shaped bottom plate formed of a synthetic resin, which is attached to the lower open end of the houding 7 by a suitable means.

The terminal member 22, the movable contact member 25, the insulating member 30, and the fixed contact member 32 are fixed to the front frame 17 by projections 20 and 20 extending from the rear surface thereof through the holes *22a*, *25a*, *30a*, and *32a* formed in the lower portions of the respective members 22 to 32 and having theirs tip end caulked. The spring member 12 is attached to the head portion 16 of the contact casing 15 after the attachment of these members is completed. The contact casing 15 containing the contact members 22 to 32 and fixed with the spring member 12 is inserted into the space *7a* defined by the side walls of the housing 7 and the side walls of the respective support members 9 and 9 with the front portion facing to the lever 2 and is fixed by the upper plate and the bottom plate 34 of the housing 7. The external terminal 24 of the terminal member 22 and the external terminal 33 of the fixed contact member 32 extend outwardly through the respective recesses 21*a* and 21*b* and respective openings, not shown, formed in the bottom plate 34 of the housing 7.

The operation of the pushbutton switch of this invention will now be described. When the pushbutton switch is not depressed, the pushbutton is urged upwardly until the projecting portions 6 and 6 of the lever 2 abut on the edge of the hole 8 of the housing 7 to be held its uppermost position. In such a condition, the zigzagged portion 14 of the spring member 12 is out of contact from the inclined portion 5 of the lever 2 and is in light contact with the resilient member 19 at 14*a* so that the projection 19*a* of the resilient member 19 is in light contact with the center of the disc portion 27 of the movable contact member 25. Thus, the disc portion 27 of the movable contact member 25 is out of contact from the fixed contact member 32 and the switch is opened.

If the pushbutton 1 is depressed by the operator, the lever 2 moves downward, causing its inclined portion 5 to push the zigzagged portion 14 of the spring member 12 and 14*b*. *In turn, the zigzagged portion 14 drives the resilient member 19 so that its projection 19a* pushes against the center of the disc portion 27 of the movable contact member 25. This causes the disc portion 27 to be snapped or turned over so as to project through the opening 31 of the insulating member 30 into contact with the fixed contact member 32, whereby the switch is closed.

When the pressure exerting on the pushbutton 1 is released, the pushbutton 1 returns to its initial position by the resilient force of the coil spring 11. As a result, the spring member 12 and the resilient member 19 also return to their initial positions by their resilient forces. Thereby, the disc portion 27 of the movable contact member 25 snaps back away from the fixed contact member 32, whereby the switch is opened.

The invention as thus described embodies an improved pushbutton switch utilizing snap-action of the resilient movable contact member to assure its stabilized switching operation and accomplish the desired objectives of very smooth switching operation without sliding noises and chattering. It is to be understood that the scope of the invention is not to be restricted to the embodiments above described but rather, in view of the numerous modifications and changes which will readily occur to those skilled in the art, the scope of the invention is set forth in the appended claims.

What is claimed is:

1. A push button switch comprising:

(a) a housing;

(b) a contact unit held within said housing, said contact unit including (i) a fixed contact member, (ii) a movable contact member disposed in parallel, spaced relation with said fixed contact member and having a disc portion bowing from the center portion of said movable contact member so as to normally extend away from said fixed contact member, (iii) an insulating member interposed between said fixed and said movable contact members and having an opening therein aligned with said disc portion, and (iiii) a resilient member disposed adjacent said movable contact member and having a projection extending toward the center portion of said disc portion;

(c) a spring member having a first portion angling outwardly away from said resilient member and a second portion angling back towards said resilient member; and (d) a lever supported for reciprocal sliding movement within said housing and adapted to engage against said first portion of said spring member upon movement in one direction so as to urge said spring member against said resilient member to push said disc member by a snap action thereof through said opening of said insulating member and into contact with said fixed contact member.

* * * * *